US007458745B2

(12) United States Patent
Stoltenberg et al.

(10) Patent No.: US 7,458,745 B2
(45) Date of Patent: Dec. 2, 2008

(54) DRAINAGE CHANNEL

(75) Inventors: Arne Stoltenberg, Budelsdorf (DE); Rainer Stolley, Budelsdorf (DE); Rino Saredi, Niederurnen (CH)

(73) Assignee: ACO Severin Ahlmann GmbH & Co. KG, Rendsburg (DE)

( * ) Notice: Subject to any disclaimer, the term of this patent is extended or adjusted under 35 U.S.C. 154(b) by 218 days.

(21) Appl. No.: 10/576,430

(22) PCT Filed: Oct. 18, 2004

(86) PCT No.: PCT/EP2004/011784

§ 371 (c)(1),
(2), (4) Date: Apr. 20, 2006

(87) PCT Pub. No.: WO2005/040513

PCT Pub. Date: May 6, 2005

(65) Prior Publication Data

US 2007/0071554 A1 Mar. 29, 2007

(30) Foreign Application Priority Data

Oct. 21, 2003 (DE) ..... 103 48 833
Nov. 13, 2003 (DE) ..... 103 53 080

(51) Int. Cl.
*E01C 11/22* (2006.01)

(52) U.S. Cl. ..... 404/2; 404/4; 405/119

(58) Field of Classification Search ..... 404/2–4, 404/25, 26; 52/11–16, 19, 20; 405/119
See application file for complete search history.

(56) References Cited

U.S. PATENT DOCUMENTS 1,700,889 A * 2/1929 Heltzel ..... 249/4
3,815,213 A * 6/1974 Evans et al. ..... 29/446
4,641,993 A 2/1987 Hahne
5,538,361 A * 7/1996 Beamer ..... 405/118
5,733,445 A 3/1998 Fanelli
5,971,662 A * 10/1999 Becker et al. ..... 405/119
6,220,784 B1 * 4/2001 Bricker ..... 405/118

(Continued)

FOREIGN PATENT DOCUMENTS

DE 1 990 786 8/1968

(Continued)

*Primary Examiner*—Raymond W Addie
(74) *Attorney, Agent, or Firm*—Hamre, Schumann, Mueller & Larson, P.C.

(57) ABSTRACT

A one-piece drainage channel for surface drainage is disclosed that comprises a molded, elongate body, in particular made of concrete polymer, with an upper surface over which vehicles can travel and which comprises inlet openings that open into a channel compartment, with side walls and a floor and with end faces to which can be connected additional drainage channels, catch pits or similar drainage installations, wherein the channel compartment comprises adjoining boundary surfaces, in particular a ceiling boundary surface nearest to the upper surface, side boundary surfaces and a base boundary surface. In order to provide easier manufacture along with high stability, even in the case of large channel widths and lengths, it is proposed to construct at least one side boundary surface and the base boundary surface or the ceiling boundary surface so that the channel compartment tapers conically in the direction from one of the end faces to the other. This allows a solid core to be used during casting of the drainage channel.

9 Claims, 1 Drawing Sheet

U.S. PATENT DOCUMENTS

| | | | | |
|---|---|---|---|---|
| 6,234,711 | B1 * | 5/2001 | Beaman | 404/4 |
| 6,905,285 | B2 * | 6/2005 | Little et al. | 405/36 |
| 6,945,733 | B2 * | 9/2005 | Rathmann et al. | 405/118 |
| 6,997,636 | B2 * | 2/2006 | Tremouilhac | 404/5 |
| 7,008,137 | B2 * | 3/2006 | Muller | 405/38 |
| 7,048,466 | B2 * | 5/2006 | Benesteau et al. | 404/4 |
| 7,134,808 | B2 * | 11/2006 | Albone et al. | 405/126 |
| 2003/0194269 | A1 * | 10/2003 | Garza | 404/2 |

FOREIGN PATENT DOCUMENTS

| | | |
|---|---|---|
| DE | 1 658 522 | 10/1970 |
| DE | 24 37 198 | 8/1974 |
| DE | 76 32 951 | 8/1977 |
| DE | 201 10 764 | 8/2001 |
| DE | 203 05 435 | 6/2003 |
| EP | 0 974 703 | 1/2000 |
| GB | 556 707 | 10/1943 |
| GB | 2 289 079 | 11/1995 |

* cited by examiner

DRAINAGE CHANNEL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to a drainage channel for surface drainage.

BACKGROUND OF THE INVENTION

Drainage channels of this kind may be used to drain surfaces where the risk of contamination by soil, (scattered) sand or foliage is relatively slight, so that there is no absolute requirement for the interior of the channel to be readily accessible for cleaning.

For manufacturing such channels with a large nominal width (300 mm) and in large lengths (2 m), the previously known method is not suitable. In that method a core, which is provided to form the channel compartment, is constructed as a delicate hollow body made of sheet metal, within which are movably mounted a set of other cores to form the inlet openings. Such types of apparatus are not only extremely complicated and sensitive, but in addition the required high nominal widths and lengths cannot be produced.

BRIEF SUMMARY OF THE INVENTION

It is an object of the invention to provide a drainage channel wherein a stable channel with large length and large nominal widths can be manufactured by simple means.

This object is achieved by a drainage channel defining a channel compartment and comprising an elongate molded body defining an upper surface over which vehicles can travel and which itself defines inlet openings that open into said channel compartment, side walls, a floor, and end faces adapted for connection to additional drainage installations such that the channel compartment is defined by a ceiling boundary surface nearest said upper surface, side boundary surfaces and a base boundary surface, said ceiling boundary surface being parallel to said upper surface and at least one side boundary surface and at least one of said base boundary surface and said ceiling boundary surface defining a tapering of said channel compartment in a direction from one of said end faces to said other end face. In a second aspect of the invention an apparatus for manufacturing such a drainage channel is provided, comprising a molding box defining at least a floor and side walls; at least one core adapted to be pulled out of said molding box and adapted to form a channel compartment that defines a cross section which tapers along its long direction and which is defined by a planar bottom surface that extends parallel to said floor, and a set of long cores adapted to form inlet openings and to taper as they extend from said floor to said at least one core.

The success of the invention resides in the fact that the channel compartment has a configuration such that a solid core, or else two solid cores taper from the channel ends toward one another, can be used to produce the channel. Whereas in previously known channels care was always taken to delimit the channel compartment by exactly parallel surfaces, with the exception at most of a tilted bottom surface, the present invention takes an entirely different approach. That is, it is accepted that channels abutting one another are offset at their interfaces or (when two cores are used) depressions and elevations and/or constrictions and expansions of the channel compartment will be produced in the long direction of a series of channels. Surprisingly, it has turned out that such steps or changes in cross section have only a negligible influence on the risk of contamination as well as on the hydraulic properties of the drainage channels.

Preferably the inlet openings are shaped so as to taper from the upper surface to the channel compartment. As a result, at the time during manufacture of the drainage channel when removal from the mold occurs, the cores to form the inlet openings need not be pulled back into the core that runs in the long direction of the channel; instead, removal from the mold can be achieved by enlarging the space between this set of cores and the longitudinal core. This design of the inlet openings is also unusual because what was previously desired was precisely the reverse direction of taper of the opening cross sections. Surprisingly, however, it has been found that even with relatively slight expansion of the opening cross sections there is no danger of contamination.

Preferably at least the inlet openings near the channel rims have edges oriented substantially linearly in the long direction of the channel. This maximizes the cross sections of the inlet openings near the channel rims. Furthermore, with this construction lateral inlet openings can be provided in the side walls, which open into the inlet openings adjacent to the rims. Such lateral inlet openings are needed to drain surface layers that are permeable to water. Because the inlet openings adjacent to the rims have edges oriented substantially linearly in the long direction of the channel, the lateral inlet openings can be formed in an especially simple manner, by cores that extend inward from the outside, so that the lateral inlet openings taper in the direction toward the interior.

At the end faces of the drainage channels junctions are preferably provided that can be filled with a sealing material. In this way absolutely leakproof trains of channels can be assembled. In this case it is advantageous for end-face inlet openings to be provided, which open into these junctions. These openings can be used to observe the sealing material that has been introduced. The end-face inlet openings are preferably constructed such that the junctions to be sealed are accessible from above, in order to inject the sealing material by an injection tool and to monitor the process. That is, whereas previously the sealing material was inserted before two adjacent channels were brought together, and the channels were then pushed together in the hope that sealing had been correctly accomplished, this sealing can now be carried out from above while being monitored and, if necessary, the seal can be repaired.

The boundary surface at the ceiling of the channel compartment in a preferred embodiment of the invention is provided with a sheet of reinforcing or filtering textile or similar flat material. This in turn is made possible only by the taper of the channel compartment and the resulting installation procedure, because the set of cores to form the drainage openings is seated on the core that runs in the long direction of the drainage channel, so that the sheet of material can be applied to this contact surface and cast along with the channel.

Preferably the upper surface comprises elevated sections near the edge, which in particular are constructed as continuous marginal strips outside the inlet openings. These marginal strips increase the channel's load-bearing capacity in that, on one hand, the marginal strips are themselves supported by the side walls of the channel and hence can tolerate loads; when a vehicle is driven over the channel in the transverse direction, the tires coming from the side first roll over the marginal region and then, with a reduced surface area, touch the more critical rib region in the middle of the channel. On the other hand, with this preferred embodiment water flowing toward the channel from the side is prevented from overflowing on the opposite side, so that the drainage action of the channel is improved.

The apparatus for manufacturing the drainage channel comprises a molding box that has at least a floor and side walls, at least one core that can be pulled out of the molding box to form an interior channel compartment, the cross section of which becomes smaller in its long direction to form a tapered shape, and a set of cores to form inlet openings, which taper from the floor of the box to the longitudinal core. The arrangement is thus definitely simple. Before the product has completely finished hardening, the channel together with the core is pressed upward. With this procedure it cannot happen that when shrinkage begins, the product shrinks onto the cores of the inlet openings and possibly fractures. The core in turn has an abrasion-resistant surface in the contact area or comprises (as a whole) an abrasion-resistant material. The core is then pulled out of the product.

Manufacture of the mold, in particular with regard to the set of cores to form the inlet openings, is made especially simple if the core has a planar lower surface extending parallel to the floor. In this case the length of all of the cores that form the inlet openings can be equal. The cores to form the inlet openings are fixedly attached to the floor. 1n the interior of some of these cores there are provided press-out rods that can be moved in the vertical direction and are inserted in such a way that no mixture of bonding agents and fillers can flow under the core region. These press-out rods are pressed upward by a device so that they lift up the conical core along with the product.

In the following, preferred embodiments of the invention are described in greater detail by way of example and with reference to the accompanying drawing.

DETAILED DESCRIPTION OF THE INVENTION

Figure 1:
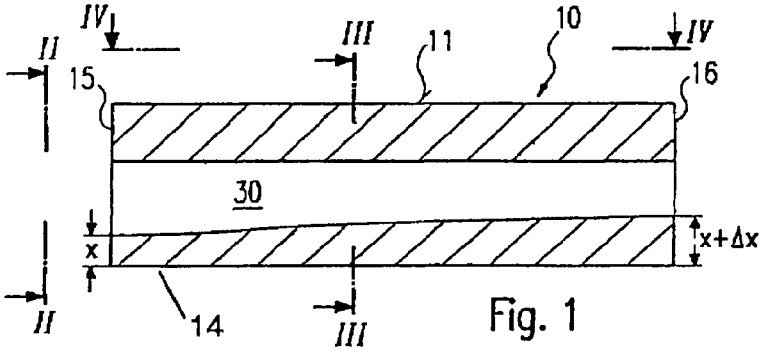
FIG. 1 shows a schematic longitudinal section through an embodiment of the drainage channel in accordance with the invention.
Figure 2:
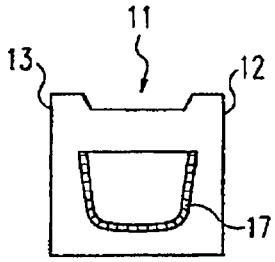
FIG. 2 shows a view along the line II-II in FIG. 1.

In the following description, the same reference numerals are used for identical parts or parts with identical actions.

Figure 3:
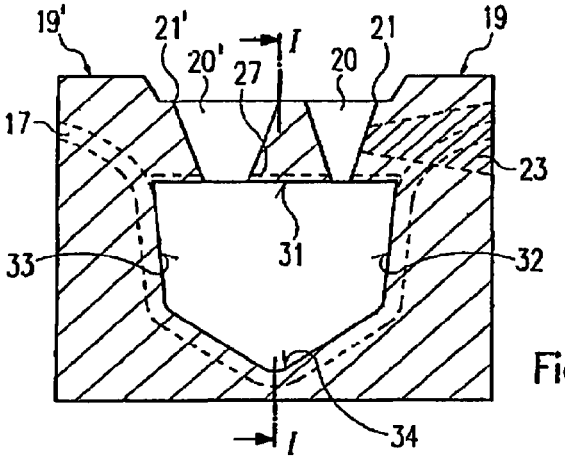
FIG. 3 shows a section through the channel along the line III-III in FIG. 1.
Figure 4:
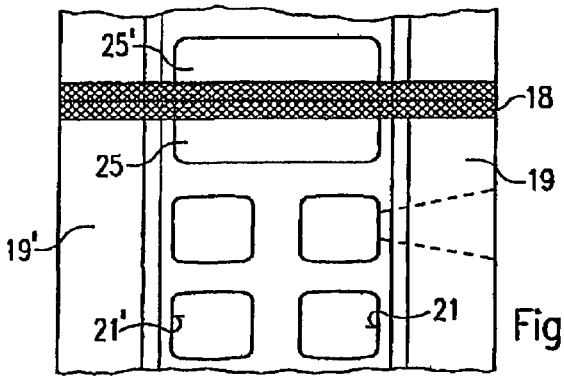
FIG. 4 shows a plan view of the channel along the line IV-IV in FIG. 1.

As shown in the drawings, the drainage channel comprises a body 10 with an upper surface 11, side walls 12, 13 and a floor 14. At end faces 15, 16 other drainage channels of this kind can be connected, or alternatively a catch pit or similar device to guide the water into a drain. At the end faces 15, 16 sealing junctions 17 can be disposed, which are indicated in FIG. 3 by a dashed line. After two such bodies 10 have positioned next to one another, the sealing junctions 17 can be filled with sealing material 18, to prevent the emergence of water that has run into a channel compartment 30.

The channel compartment 30 has a ceiling boundary surface 31 oriented parallel to the upper surface 11. Lateral boundary surfaces 32, 33 and a base boundary surface 34 are slightly tilted from the one end face 15 to the other end face 16, i.e. are slanted with respect to the associated (plane-parallel) exterior or bottom surfaces of the body 10, so that the height difference shown in FIG. 1 between the thickness x at the one end face 15 and the thickness $x+\Delta x$ is produced. With substantially the same advantages it is also possible to operate with two mold cores, so that at both end faces 15, 16 the material has the same thickness x, while the increased thickness $x+\Delta x$ is present substantially in the middle of the body 10. It should further be pointed out that substantially the same advantages also accrue when only one of the lateral boundary surfaces 32, 33 contributes to the conicity.

As shown in FIG. 3, the upper surface 11 of the channel is provided with marginal ridges 19, 19', extending as Continuous marginal strips over the full length of the channel outside the inlet openings. Thus protection of the fragile channel portions, the inlet openings 20, 20' are situated in, is ensured.

In the upper surface 11 of the body 10 inlet openings 20, 20' are provided, which taper from top to bottom as they pass through the wall, i.e. into the channel compartment 30. The inlet openings 20, 20' preferably are rectangular in cross section, in particular having edges 21, 21' at their outer ends that are substantially linear. This construction makes it possible to provide lateral inlet openings 23 (see FIG. 3) that open into the (vertical) inlet openings 20, 20'. Owing to the linear shape of the edges 21, 21' the inflow cross section can be maximized while still enabling simple shaping of the cores needed to form the lateral inlet openings 23.

In the region of the end-face walls 15, 16 end-face inlet openings 25, 25' are provided, which extend substantially over the entire interior width of the channel. When two channel bodies 10 are put together, an enlarged inlet opening 25/25' is produced, through which the sealing junctions 17 are accessible from above, so that the sealing material 18 can be injected from above and in particular can be observed from above. This opportunity for observation applies in particular to the channel compartment 30, and simultaneously enables subsequent repair of damaged regions of the seal.

To reinforce the upper surface 11 of the body 10 a sheet of material 27, e.g. a woven fabric of glass fibers or similar strengthening fabric, is cast along with the body in the region of the ceiling boundary surface 31, i.e. precisely in the region where the tensile stress is highest when a bending load is imposed. The sheet of material 27 can also be a filter material, which prevents solid objects from entering the channel compartment. Cleaning can easily by carried out by suction devices.

Figure 5:
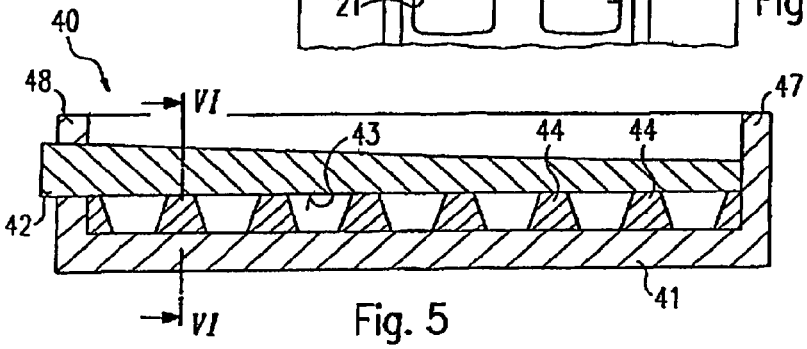
FIG. 5 shows a schematic longitudinal section through a mold to produce a drainage channel.
Figure 6:
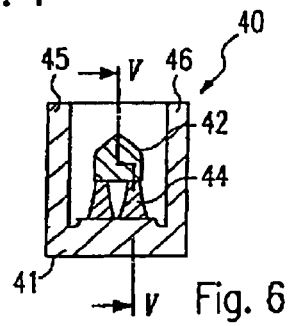
FIG. 6 shows a section along the line VI-VI in FIG. 5.

The drainage channel described here is manufactured by means of a casting mold such as is described below with reference to FIGS. 5 and 6.

The casting mold comprises a molding box 40 with a floor 41 and side walls 45, 46 as well as end walls 47, 48. Through one end wall 48 a core 42 is inserted into the molding box 40, and can also be pulled out of the molding box 40 (toward the left, in FIG. 5). The core 42 comprises a lower surface 43 that is flat, i.e. extends plane-parallel to the floor 41.

A set of cores 44 is provided, projecting upward from the floor 41; these serve to form the inlet openings.

To manufacture a drainage channel of the kind described above, the mold shown in FIGS. 5 and 6 is set up and filled from above with a mixture of resin and fillers, in particular sand. After the mixture has hardened, the core 42 is pulled out of the molding box 40. Then the finished drainage channel can be pulled upward to extract it from the molding box 40. During this procedure the set of cores 44 is preferably fastened firmly to the floor 41, so that these cores remain within the mold. It should be pointed out here that only the most important parts of the molding box 40 have been described, and hence the parts of the mold that form the sealing junctions, for example, have not been further explained.

The invention claimed is:

1. Drainage channel for surface drainage, comprising:

first and second elongate molded bodies each having opposite end faces, side walls, a floor, and an upper surface over which vehicles can travel, each of said molded bodies including a channel compartment, said channel compartment being defined by a ceiling boundary surface nearest said upper surface, side boundary surfaces and a base boundary surface, said upper surface having side edges in a longitudinal direction extending between said end faces, at least one of said side boundary surfaces and said base boundary surface tapering in a direction from a first of said end faces to a second of said end faces, said end faces including sealing junctions, said first and second elongate molded bodies including in said upper surface a plurality of inlet openings with one of lateral and longitudinal ribs separating one of said inlet openings from another, said inlet openings have opening linear edges oriented substantially parallel with the longitudinal side edges of the upper surface of said channel thereby maximizing cross-sectional area of the inlet openings, and a sealing material provided at the sealing junctions of said second of said end faces of said first elongate molded body and said first of said end faces of said second elongate molded body.

2. Drainage channel according to claim 1, wherein said inlet openings taper from said upper surface to said channel compartment.

3. Drainage channel according to claim 1, wherein said side walls define lateral inlet openings, which open into the inlet openings.

4. Drainage channel according to claim 3, wherein said lateral inlet openings taper toward said inlet openings.

5. Drainage channel according to claim 1, wherein said end faces define end-face inlet openings that open into said end faces.

6. Drainage channel according to claim 5, wherein said end-face inlet openings are constructed such that said sealing junctions are accessible for entry by an injection tool for the injection of said sealing material.

7. Drainage channel according to claim 1, wherein said upper surface comprises elevated sections at its edge.

8. Drainage channel for surface drainage, comprising:

first and second elongate molded bodies each having opposite end faces, side walls, a floor, and an upper surface over which vehicles can travel, each of said molded bodies including a channel compartment, said channel compartment being defined by a ceiling boundary surface nearest said upper surface, side boundary surfaces and a base boundary surface, said ceiling boundary surface being parallel to said upper surface, at least one of said side boundary surfaces and said base boundary surface tapering in a direction from a first of said end faces to a second of said end faces, said end faces including sealing junctions, said first and second elongate molded bodies including inlet openings in said upper surface, said upper surface having edges extending between said end faces, said upper surface including elevated sections outside said inlet openings and near said edges of said upper surface with rib regions between said elevated sections; and a sealing material provided at the sealing junctions of said second of said end faces of said first elongate molded body and said first of said end faces of said second elongate molded body;

wherein said elevated sections tolerate loads from vehicles better than rib regions between said elevated sections, and wherein water flowing from one side over an elevated section of said channel is prevented from overflowing on an opposite side over another of the elevated sections before entering said inlet openings thereby improving drainage action.

9. Drainage channel according to claim 8, wherein said ceiling boundary surface is provided with at least one of a reinforcing material and a filter fabric.

* * * * *